United States Patent [19]

Takahara

[11] Patent Number: 4,565,044

[45] Date of Patent: Jan. 21, 1986

[54] METHOD OF FORMING BUILDING FOUNDATION WITH VENTS

[76] Inventor: Susumu Takahara, 1217, Ijiri 3-chome, Minami-ku, Fukuoka-shi, Fukuoka-ken, Japan

[21] Appl. No.: 587,851

[22] Filed: Mar. 12, 1984

Related U.S. Application Data

[62] Division of Ser. No. 313,194, Oct. 20, 1981, abandoned.

[30] Foreign Application Priority Data

Feb. 27, 1981 [JP] Japan ..... 56-27579[U]

[51] Int. Cl.[4] ..... E04B 1/16; E04B 1/70

[52] U.S. Cl. ..... 52/741; 52/294; 52/302; 52/743; 52/204; 264/35; 249/39

[58] Field of Search ..... 249/35, 39, 94; 264/31, 264/35, 271.1; 52/743, 204, 294, 302

[56] References Cited

U.S. PATENT DOCUMENTS

| | | | |
|---|---|---|---|
| 371,180 | 10/1887 | Dexter | 98/32 |
| 2,110,863 | 3/1938 | Barnett | 52/704 |
| 2,610,569 | 9/1952 | Horne | 98/32 |
| 2,648,877 | 8/1953 | Vermilya | 52/293 |
| 3,173,186 | 3/1965 | Lawrence | 264/35 |
| 4,026,882 | 5/1977 | Crofoot | 52/302 |
| 4,211,050 | 7/1980 | Cvacho | 52/169.14 |
| 4,348,344 | 9/1982 | Nobbe | 264/31 |

FOREIGN PATENT DOCUMENTS

| | | | |
|---|---|---|---|
| 168101 | 8/1959 | Sweden | 98/31 |

*Primary Examiner*—John E. Murtagh

*Attorney, Agent, or Firm*—Wenderoth, Lind & Ponack

[57] ABSTRACT

A method for forming a building concrete foundation including the steps of molding integral concrete main and partition footings, embedding metal molds into the main and partition footings while the concrete of the footings are in a partially solidified condition and after the solidification of the concrete, removing the molds from the footings to thereby form ventilation areas on the footings.

8 Claims, 8 Drawing Figures

METHOD OF FORMING BUILDING FOUNDATION WITH VENTS

This application is a division, of now abandoned application Ser. No. 313,194, filed Oct. 20, 1981, now abandoned.

BACKGROUND OF THE INVENTION

This invention relates to a foundation assembly for wooden buildings to be protected against possible damage from white ants and a method for forming the building foundation assembly.

At present, it has been known that about 50–60% of existing wooden buildings are damaged by white ants and the number of wooden buildings suffering from white ant damage will increase year after year.

Since the conventional foundation assemblies for wooden buildings are so constructed that white ants are willing to inhabit the buildings, the wooden buildings are easily damaged by white ants. Any of the conventional building foundation assemblies comprises a concrete foundation and a wooden sill built on the concrete foundation. The concrete foundation is generally so formed that the under-floor space is isolated from the air from the atmosphere and the concrete foundation is provided with only a few, if any, ventilation areas. The concrete foundation has a high moisture absorption (after solidification, concrete includes voids which account for about 10% of the total volume of the concrete and provides moisture absorptivity to the concrete foundation) and the wooden sill absorbs moisture from the concrete foundation. White ants are willing to inhabit dark areas where high temperature and moisture conditions are present and the air is stagnant. Thus, in the conventional wooden buildings as described hereinabove, the foundation assembly and the space under the flooring of a wooden building are suitable habitats for white ants. Since white ants are fond of eating substances containing moisture as their provisions, the ants tend to eat away the wooden sill and concrete foundation resulting in the collapse of the building foundation assembly.

Furthermore, the conventional wooden building foundation assembly has the disadvantages that the foundation assembly tends to decay easily and the decay progresses rapidly in the foundation assembly. More particularly, the wooden sill tends to absorb moisture from the concrete foundation and the moisture causes dry rot on the wooden sill, since the under-floor space surrounded by the foundation assembly has poor ventilation and high humidity the dry rot of the wooden will is accelerated. The dry rot on the wood of the wooden sill deteriorates the ferrous material of the concrete foundation which presents a serious problem in the building. In fact, it has been found that in wooden buildings, the dry rot on the connection between the upper surface of the concrete foundation and the lower surface of the wooden sill built on the concrete foundation would spread over the area as much as about one fourth to one third of the entire surface area on the connection in about 20–30 years. In order to solve the dry rot problem, it has been proposed to destroy white ants and/or prevent the ants from inhibiting the wooden building by spraying and/or injecting chemicals such as insecticides for white ants or the like. However, such chemicals tend to deteriorate and cannot be expected to maintain their effectiveness for a long period of time. Thus, the conventional wooden building foundation assembly would again become habitats suitable for white ants after the deteriorate of such chemicals.

SUMMARY OF THE INVENTION

Thus, a principal object of the present invention is to provide a building foundation assembly in the light of the fact that white ants cannot inhabit and ruin naturally areas where relatively low temperature and humidity conditions are present, provisions for white ants are not available and air can always flow freely therethrough.

Another object of the present invention is to provide a building foundation assembly which maintains the under-floor space at a relatively low temperature and which can be effectively protected against possible dry rot by enhancing ventilation there.

Another object of the present invention is to provide a method for forming a building foundation assembly which can be effectively protected against potential damage by white ants and dry rot.

Another object of the present invention is to provide a metal mold by which ventilation areas are easily formed on the concrete foundation so as to enhance the ventilation of a building foundation assembly.

In order to attain the above-mentioned objects of the present invention, according to the present invention, the main footing is provided on the top thereof with recessed air vents, the partition footing is provided on the top with recessed air vents and on the sides with through vent holes, the ground under the flooring of a building is formed with concrete moisture shielding partitions and the main footing has a water-proof layer applied to the inner side thereof. Also ventilation area forming means consisting of metal molds and/or a perforated plastic board are employed in the formation of the recessed air vents on the main and partition footings.

The above and other objects and attendant advantages of the present invention will be more readily apparent to those skilled in the art from a reading of the following detailed description in conjunction with the accompanying drawings which show exemplified embodiments of the invention for illustration purpose only, but not for limiting the scope of the same in any way.

DETAILED DESCRIPTION OF THE PREFERRED EMBODIMENT

Figure 1:
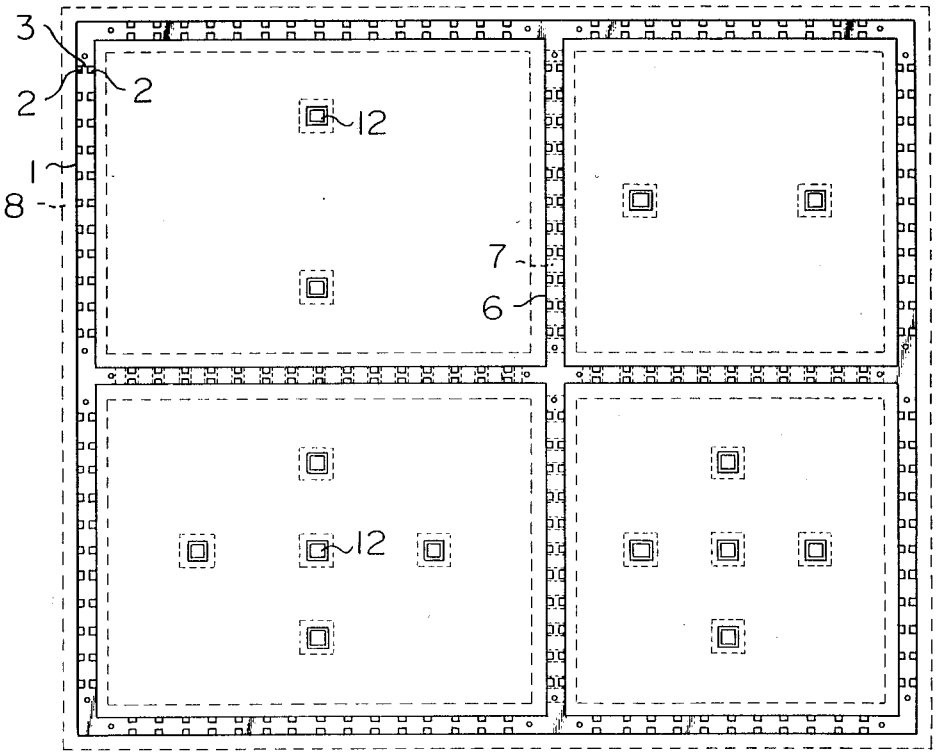
FIG. 1 is a plan view of one embodiment of the concrete foundation of the building foundation assembly constructed in accordance with the principle of the present invention.

The building foundation assembly of the present invention generally comprises a concrete foundation and a wooden sill built on the concrete foundation. As is clearly shown in FIG. 1, the concrete foundation generally comprises a main footing 1, a partition footing 6 and mound footings 12. The components include horizontal portions 8 adapted to be buried in the ground and vertical portions 9 extending uprightly from the horizontal portions 8 (see FIGS. 2 and 3).

Figure 2:
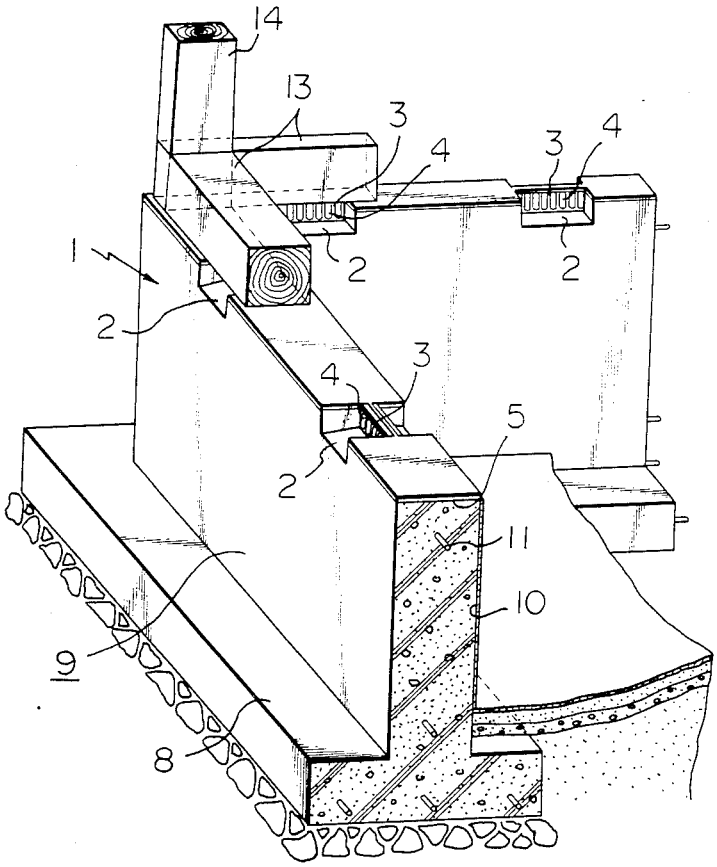
FIG. 2 is a fragmentary perspective view on an enlarged scale showing one corner of said building foundation assembly as shown in FIG. 1.

As more clearly shown in FIG. 2, the wooden sill is built on the tops of the main, partition and mound footings of the concrete foundation.

In the building foundation assembly of the invention as described above, the vertical portion 9 of the main footing is provided on the top thereof with a plurality of ventilation areas 2 in an equally spaced relationship along the longitudinal direction of the vertical portion 9 as shown in FIG. 2. The ventilation area 2 is formed by forming opposite recesses on the top of the associated vertical portion 9 on the opposite or inner and outer sides of the vertical portion so as to form a perforated wall 3 between the inner and outer recesses. The intermediate perforated wall 3 is provided with a plurality of spaced vertical communication holes 4 which communicate between the inner and outer recesses. By the provision of the ventilation areas 2 on the main footing vertical portion 9, the under-floor space surrounded by the building foundation assembly where usually ventilation is not available and high humidity is present can be communicated with the atmosphere through the ventilation areas 2 whereby the space is ventilated and as a result, the humidity level in the under-floor space can be reduced and the opportunity that the concrete foundation and wooden sill are interconnected by frozen drops of dew is substantially reduced or eliminated. Thus, the ventilation in the entire under-floor space is improved and the humidity in the space is also reduced whereby the possiblility of inhabitation of white ants in the under-floor space and that of the dry rot of the wooden sill can be eliminated.

Figure 3:
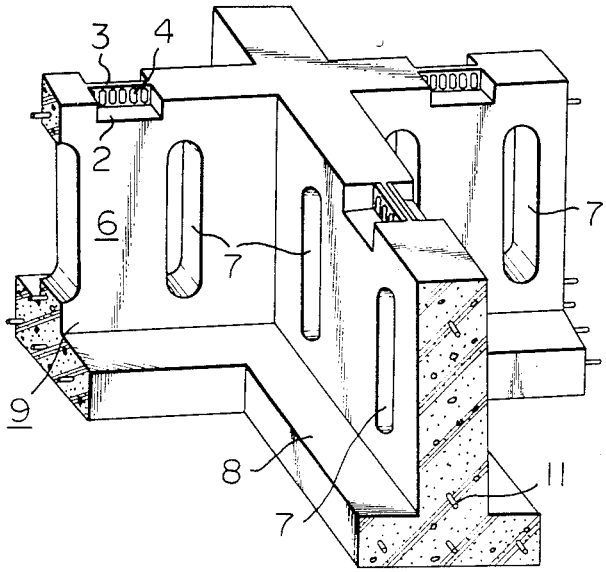
FIG. 3 is a fragmentary perspective view on an enlarged scale showing the concrete foundation partition footing.

When the partition footing 6 and mound footings 12 are also provided with air ventilation areas similar to the air ventilation areas 2 provided on the main footing 1, the building foundation assembly can be more effectively protected from potential damage by white ants and potential dry rot due to insufficient ventilation. As shown in FIG. 3, the partition footing 6 is provided on the side thereof with a plurality of spaced vertical through ventilation holes 7 in addition to the top ventilation areas 2 which are formed in the same manner as described in connection with the ventilation areas 2 on the main footing 1. Thus, the air from the atmosphere passes through the communication holes 4 at the ventilation areas 2 on the main footing 1, and the communication holes 4 at the ventilation areas 2 on the partition footing 6 and partition footings 12 and through the ventilation holes 7 in the partition footing 6 and finally passes through other parts of the ventilation areas 2 on the main footing into the atmosphere. As a result, the moisture emitting from the square timber members 13, 14 (see FIG. 2) which constitute the wooden sill on the main, partition and mound footings 1, 6 and 12 is prevented from stagnating and accumulating in the under-floor space.

In order to further reduce the humidity level in the under-floor space, it is preferable that water proofing layers of resin or the like are formed on moisture shielding concrete partition walls placed on the ground under the building flooring surrounded by the building foundation assembly. By the provision of the water proofing layers on the concrete main footing or the concrete partition walls on the exposed ground under the building flooring surrounded by the building foundation assembly, the rise in level of the moisture emitting from the under-floor ground and the building foundation assembly is prevented and at the same time, the weathering of the building foundation assembly itself is prevented or substantially retarded. Furthermore, since the plurality of ventilation areas 2 are provided in the connection between the concrete footings and wooden sill, the contact area between the concrete footings and wooden sill is reduced. As a result, the wooden sill can be maintained dry and the ventilation areas 2 provide ventilation and natural illumination effects which tend to cause white ants to desist from inhabiting the under-floor space and on the wooden sill. With the above-mentioned construction of the building foundation assembly, as compared with the prior art building foundation assembly where the ventilation areas are provided in the central areas of the vertical portions of the main concrete footing, a substantially high compressive strength is provided to the building foundation assembly of the invention.

Figure 4:
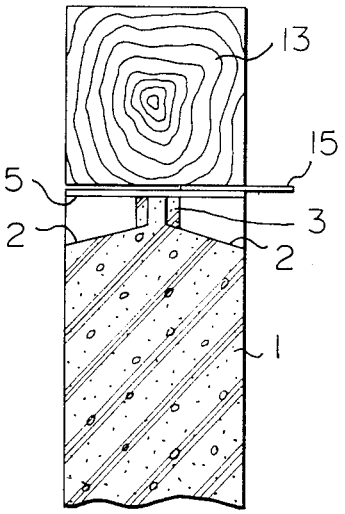
FIG. 4 is a fragmentary vertically sectional view on a further enlarged scale especially showing a white ant preclusion means.

In the building foundation assembly of the invention, when insecticide 5 for white ants is applied to the connection between the concrete foundation and wooden sill as shown in FIG. 4, the insecticide applied area is protected against potential damage by white ants and at the same time, the air passing through the under-floor space scatters the insecticide about to destroy white ants inhabiting in the under-floor space. If desired, a board 15 formed of any desired or suitable material can be employed in the connection between the concrete foundation and wooden sill for the same purpose in place of the insecticide within the scope of the invention and a screen is preferably provided in the air vent so that insects are prevented from entering the under-floor space through the air vent.

Figure 5:
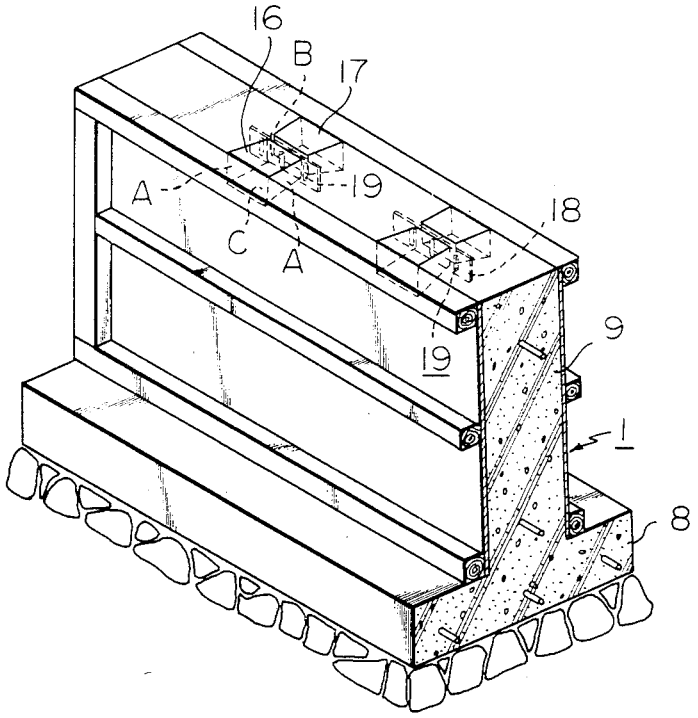
FIG. 5 is a view showing a method for forming ventilation areas on the concrete foundation according to the present invention.

FIG. 5 shows one embodiment of the main concrete footing having ventilation areas of the building foundation assembly of the invention.

The building foundation assembly is constructed by forming the concrete foundation with an inverted T-shaped cross-section and building the wooden sill on the concrete foundation in the conventional manner. The air vents are formed by embedding metal molds into the concrete foundation in predetermined positions in the foundation while the concrete of the foundation is in its partially solidified condition and then removing the molds out of the foundation before the concrete of the foundation solidifies completely. The following examplary procedures can be employed for forming the air vents in the concrete foundation.

In one (first) examplary procedure concrete is placed to a concrete foundation mold and after a partial solidification of the concrete, pairs of air vent metal molds having a substantially U-shaped cross-section are embedded to the top of the vertical portion 9 of the concrete foundation on the opposite sides of the vertical portion 9 leaving a space between the opposing molds so as to position the two molds 16, 17 in each pair in alignment with each other with a perforated partition board 18 interposed between the molds.

After the placing of concrete to the foundation mold, the foundation is left as it is for about 1–2 weeks to allow the concrete to solidify and after the solidification of the concrete, the air vent molds 16, 17 are removed from the concrete foundation to form the ventilation areas 2 each consisting of a pair of opposite and aligned recesses or air vents separated by an intermediate perforated wall provided with communication holes which communicate between the recesses (see FIG. 5).

In an alternative (second) procedure, the intermediate perforated wall is integrally formed with the body of the concrete foundation and provided with the communication holes in any suitable manner. The communication holes are formed by the employment of the metal molds 16' and 17' as shown in FIG. *7b*, for example. The mold 16' has a plurality of spaced vertical projections 20 on one or the inner side thereof. The mold 17' is provided on one or the inner side thereof with a plurality of holes 21 corresponding in number, position and configuration to the projections 20 on the mold 16'. The mold 17' is similar to the mold 16' in configuration, but not provided with the projections 20. In forming the ventilation areas 2 on the concrete foundation, the molds 16', 17' are embedded into the vertical portion 9 of the concrete foundation with the projections 20 facing the adjacent side of the mold 17' until the projections 20 abut against the adjacent side of the mold 17'. After the solidification of the concrete, the molds 16', 17' are removed from the solidified concrete foundation to form the ventilation areas 2 on the concrete foundation. The size of the ventilation areas is preferably so selected that the ventilation areas accelerate natural ventilation of the under-floor space but prevent insects from entering the space.

In the first procedure, concrete is placed into a concrete foundation mold and after the concrete has solidified partially, molds 16, 17 having a substantially U-shaped cross-section are embedded into the vertical portion of the partially solidified concrete foundation in the orientation as described in connection with the second procedure 1 and at the same time, the perforated board 18 having a plurality of spaced communication holes 19 is embedded into the partially solidified concrete from the top of the vertical portion in an intermediate position between the molds 16, 17. The perforated board 18 is a transparent plastic board, for example. After the concrete has solidified (in about 1–2 weeks after the placement of concrete), the molds 16, 17 are removed from the concrete leaving the perforated board therein to form recesses or air vents on the opposite sides of the board and as a result, the ventilation areas 2 consisting of the opposite recesses or air vents which communicate with each other through the communication holes 19 in the board 18 are formed.

Figure 6:
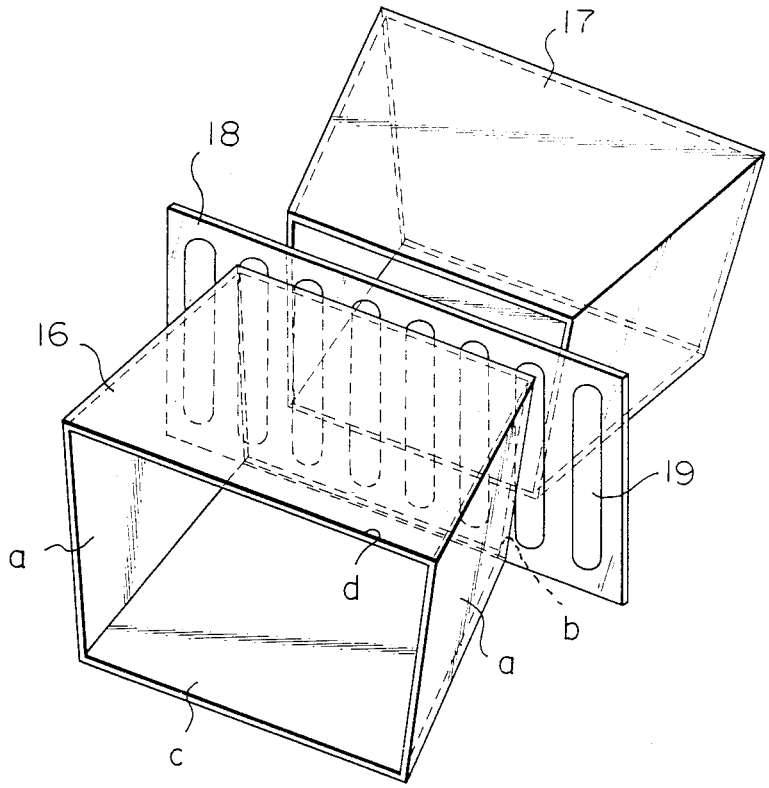
FIG. 6 is a fragmentary perspective view on a further enlarged scale showing metal molds and a perforated board which form air vents in the concrete foundation.
Figure 7A:
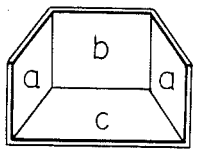
FIGS. 7*a* and 7*b* are perspective views of different metal molds employed in the formation of air vents in the concrete foundation.
Figure 7B:
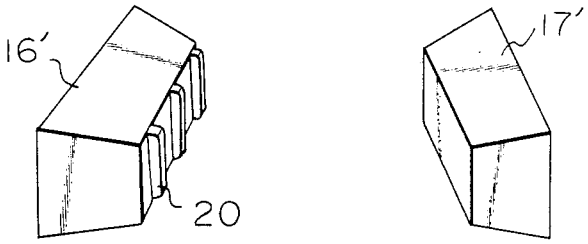

Examples of molds for use in the formation of the ventilation areas on the concrete foundation according to the first procedure will be now described referring to FIG. 6 and FIG. *7a*.

The mold shown in FIG. 6 has a substantially trapezoidal configuration and includes the opposite side faces a, inner side face b, bottom face c and upper face d. The faces a and b form side walls A and B, respectively and the bottom face c forms the bottom wall C.

FIG. *7a* shows a bottomed metal mold having a substantially U-shaped cross-section open on the top and includes the opposite side faces a, inner end face b and bottom face c. The side faces a form the side walls A, the bottom face c forms the bottom wall C, the end face b forms the inner end wall B and the bottom face c forms the bottom wall C.

FIG. *7b* shows a set of mating metal molds 16', 17' which are adapted to simultaneously form inner and outer recesses and a communication wall at the ventilation area 2 for use in the second procedure. The metal mold 16' is formed on one or the inner side with a plurality of spaced vertical projections 20 and the metal mold 17' is similar to the metal mold 16' in configuration, but not provided with the projections 20. In the formation of the ventilation areas 2 on the concrete foundation, the metal molds 16', 17' are embedded into the vertical portion 9 of the foundation on the opposite sides thereof with the inner sides of the two molds facing each other until the projections 20 abut against the adjacent side of the metal mold 16' to thereby form the ventilation area 2 consisting of opposite recesses or air vents which are communicated through the communication holes formed by the cooperating projections 20 of the mold 16' and the adjacent side of the mold 17'.

One example of the perforated board for use in the first procedure is shown in FIG. 6.

The perforated board 18 has a size and shape suitable to the size and shape of the ventilation area to be formed, that is, the length of the perforated board should be so selected that the opposite ends of the board extend beyond the opposite ends of each of the metal molds. Furthermore, the perforated board is provided with a plurality of spaced through holes which communicate between the opposite recesses or air vents so that the under-floor space can be ventilated naturally and insects are prevented from entering the space.

While certain forms of the present invention have been described and illustrated, it is not to be limited thereto except insofar as such limitations are included in the following claims.

What is claimed is:

1. A method for forming a wooden building foundation assembly including a concrete foundation provided on the top with a plurality of ventilation areas in spaced relationship along the length of the foundation and a wooden sill built on the concrete foundation, comprising the steps of placing concrete into a foundation mold to form the concrete foundation, forming pairs of opposing recesses on the top of the concrete foundation on the opposite sides of the foundation while the concrete is in a partially solidified condition with the two opposing recesses in each pair being positioned spaced from each other, forming an intermediate perforated communication wall between the opposing recesses of each pair during said step of forming pairs of opposing recesses, and building the wooden sill on the concrete foundation after solidification of the concrete.

2. A method as in claim 1, wherein said steps of forming pairs of opposing recesses and an intermediate perforated communication wall include embedding substantially trapezoidally shaped metal moldings into the top of the concrete foundation on the opposite sides of the foundation while the concrete of the foundation is in its partially solidified condition and removing the metal molds from said foundation after a predetermined period of time.

3. A method as in claim 1, wherein the steps of forming pairs of opposing recesses and an intermediate perforated communication wall include embedding substantially trapezoidally shaped metal molds in the top of the concrete foundation on the opposite sides of the foundation while the concrete of said foundation is in its partially solidified condition, and simultaneously embedding a perforated communication board between the metal molds and then removing the metal molds from the concrete foundation after a predetermined period of time, leaving the perforated communication board in the foundation.

4. The method as in claim 1, wherein the steps of forming pairs of opposing recesses and an intermediate perforated communication wall include simultaneously embedding a substantially trapezoidally shaped metal mold having a plurality of projections on one side thereof and a substantially trapezoidally shaped metal mold having a plurality of through holes corresponding to the projections in number, shape and position into the top of the concrete foundation with the projections and through holes facing each other on the opposite sides of the foundation until the projections are received in the through holes while the concrete of the concrete foundation is in its partially solidified condition so as to form a perforated communication wall of concrete integrally with the concrete foundation, and removing the metal molds from the concrete foundation after a predetermined period of time.

5. The method as set forth in claim 1, wherein the step of forming pairs of opposing recesses and an intermediate perforated communication wall includes the step of forming a ventilation area by notching the concrete foundation on the opposite sides of the foundation to form notches extending a predetermined depth from the top and embedding a perforated communication board having a plurality of through holes into the concrete foundation in an intermediate position between the notches.

6. The method as set forth in claim 3, in which said perforated communication board is a plastic board.

7. The method as set forth in claim 5, in which said perforated communication board is a plastic board.

8. A method for forming a wooden building foundation assembly including a concrete foundation provided on the top thereof with a plurality of ventilation areas in spaced relationship along the length of the foundation and a wooden sill built on the concrete foundation, comprising the steps of:

(a) placing concrete into a foundation mold to form the concrete foundation;

(b) simultaneously embedding a substantially trapezoidally shaped metal mold having a plurality of projections on one side thereof and a substantially trapezoidally shaped metal mold having a planar front face into the top of the concrete foundation with the projections extending to the planar front face, while the concrete of the concrete foundation is in a partially solidified condition so as to concurrently form opposing recesses in the foundation and an intermediate perforated communication wall of concrete between the opposing recesses of each pair during the step of embedding;

(c) removing the metal molds from the concrete foundation after a predetermined time; and (d) building the wooden sill on the concrete foundation after solidification of the concrete.

* * * * *